US005104095A

United States Patent [19]

Elliott et al.

[11] Patent Number: 5,104,095

[45] Date of Patent: Apr. 14, 1992

[54] APPARATUS FOR SEPARATING MOLTEN SALT FROM MOLTEN SALT OR MOLTEN URANIUM OR MOLTEN URANIUM ALLOY

[76] Inventors: Guy R. B. Elliott, 133 La Senda Rd., Los Alamos, N. Mex. 87544; James J. Glass, P.O. Box 23, San Jose, N. Mex. 87565; Russell D. Elliott, 1896 Lorca Dr. #34, Santa Fe, N. Mex. 87501

[21] Appl. No.: 491,660

[22] Filed: Mar. 12, 1990

[51] Int. Cl.[5] ..... C21D 11/00

[52] U.S. Cl. ..... 266/87; 266/230; 75/398; 252/626

[58] Field of Search ..... 75/398, 407; 423/258, 423/259, 5; 266/227, 230, 87, 88, 205; 252/626

[56] References Cited

U.S. PATENT DOCUMENTS

| | | | |
|---|---|---|---|
| 1,472,006 | 10/1923 | Jones | 75/407 |
| 3,049,423 | 8/1962 | Reavis et al. | 75/397 |
| 3,063,829 | 11/1962 | Reavis et al. | 75/397 |
| 3,401,925 | 9/1968 | Evans et al. | 266/205 |
| 3,483,913 | 12/1969 | Grosvenor et al. | 164/55.1 |
| 3,550,925 | 12/1970 | Evans et al. | 266/205 |
| 4,295,884 | 10/1981 | Hicter et al. | 75/604 |
| 4,526,679 | 7/1985 | Litzinger | 209/3 |
| 4,534,792 | 8/1985 | Elliott | 75/398 |
| 4,552,588 | 11/1985 | Elliott | 75/398 |
| 4,564,507 | 1/1986 | Elliott | 423/5 |
| 4,591,382 | 5/1986 | Elliott | 75/398 |
| 4,636,250 | 1/1987 | Elliott | 75/398 |

*Primary Examiner*—Brooks H. Hunt
*Assistant Examiner*—Ngoclan T. Mai

[57] ABSTRACT

Apparatus for separating molten salt by-product phase from molten uranium or molten uranium alloy product phase using a barrier which passes molten salt but retains molten uranium or molten uranium alloy. The operation of the barrier relies on the differences in the physical behavior of said molten salt from the behavior of said molten uranium or molten uranium alloy as they interact with each other and with said barrier.

6 Claims, 4 Drawing Sheets

APPARATUS FOR SEPARATING MOLTEN SALT FROM MOLTEN SALT OR MOLTEN URANIUM OR MOLTEN URANIUM ALLOY

BACKGROUND OF THE INVENTION

1. Field of the Invention

This invention relates to a method of continuously separating a molten salt by-product phase from a molten uranium or molten uranium alloy product phase by use of a barrier which will pass molten salt but retain molten metal. Application of the method is possible in such activities as (a) production of uranium from uranium fluoride; (b) separation of uranium from solid mixtures of uranium and salt; (c) preparation of uranium alloys; (d) direct casting, i.e., without remelting; (e) recovery and cleaning of uranium scrap for recycle; and (f) molten by-product decontamination.

2. Description of the Related Art

The opposite separation, i.e., passing molten uranium or molten uranium alloy and retaining molten salt, was employed in earlier patents by G. R. B. Elliott: U.S. Pat. Nos. 4,534,792; 4,552,588; 4,564,507; 4,591,382; 4,636,250; Canadian 1 241 201; 1 241 202; and European application (accepted) 85302664.9. All the earlier claims are tied to the use of a molten uranium trap, which trap is based on the high density of uranium relative to that of the molten salt. That earlier separation uses a very different concept from that of the present invention, which is primarily tied to the highly dissimilar interfacial behaviors of the molten phases in their interactions with ceramics and other third phase materials.

None of the earlier Elliott patents are in commercial use yet, although we have used the concepts in operations at our pilot plant.

Commercial large scale uranium production is based on batch reductions, almost exclusively by the Ames process, which is described below. In the U.S. that process is used by the two still active commercial producers of the uranium, and it has been used commercially by at least six other producers, private or governmental.

The operational form of the Ames process is still used basically as it was developed in World War II under wartime pressures and concerns. Heated uranium fluoride (usually the tetrafluoride) with chipped magnesium reacts at temperatures rising to around 1500° C. and pressures of magnesium vapor of hundreds of pounds per square inch. During the reaction radioactive reagents and products escape to the air and have repeatedly escaped to the outside environment also. Next, large amounts of molten magnesium fluoride and molten uranium (as much as 4500 pounds per batch) are formed, caus-safety problems in some cases, at least. These molten phases are frozen and cooled to room temperature where they are manually broken apart. The uranium product ("derby") must be remelted before it is cast, and alloying elements can also be added. The by-product comprising primarily magnesium fluoride is radioactive enough to cause serious environmental problems in disposal, and it is not suitable for recycle.

Now people justifiably have demanded safety and environmental protection: Of the eight producers just mentioned, two dropped out before environmental concerns became dominant, and four have shut down because of environmental problems connected with the Ames process. These closures are in spite of what has been recognized as great importance of uranium production for National security.

The Ames process, therefore, is demonstrated to be seriously flawed for current usage. The basic problem has been the absence, until the recent Elliott inventions, of any means to carry out the reductions at atmospheric pressure and continuously.

The present invention is complementary to the earlier Elliott inventions noted. Although some of the activities could be done with either continuous separations method alone, others need, or perform better with, both separations performed simultaneously, as discussed in the summary.

SUMMARY OF THE INVENTION

As is indicated in the previous discussions, unacceptable flaws have been demonstrated in current means of commercial production of uranium. Consistent with the previous discussions, the major problems of the commercial technology could be corrected if: (a) the separation of molten salts and molten metal could be continuous, (b) the formation or treatment of uranium and its alloys could be continuous, (c) operations could be in inert gas at lower temperatures and at substantially atmospheric pressure, (d) the amount of molten salt by-product and molten uranium product retained in the reaction region could be kept small, and (e) the by-product could be better decontaminated while it was still molten. The present invention offers solutions to these problems:

First, a novel method of separation of the molten salt phase from molten uranium or uranium alloy phase uses differences in the physical properties of the two phases when both are in the presence of ceramics or other container or separator materials, e.g., graphite. Examples of such properties are densities, wetting characteristics, and surface tensions. These characteristics are utilized to design conditions which will allow molten salt to pass continuously through or around a barrier which retains molten metal. The barrier may be made of material which is wet by molten salt but not by molten uranium; then holes of sufficiently small size through the material may pass the wetting molten salt but retain non-wetting molten uranium by reverse capillary action. A frit may work in this way. Wicks and syphons are other examples of possible ways to move around barriers.

A related solution, as was noted, is the use of a molten alloy trap as was described earlier and used at our pilot plant. That kind of trap is not adequate for some purposes of the present invention, however, as will be discussed.

No solution to the phase separations and continuous operations has been available in commercial facilities, but the value of continuous operations was recognized. Pressurized semicontinuous operations were sought through research and development in the period 1960–1975 at the Federal Feed Materials Production Center at Fernald, Ohio. However, the development failed because people had sought a solid mechanical device which could be opened intermittently to release product metal, yet no solids could stand up to rubbing while in contact with molten salt, molten uranium, and impurities. A solution to this problem makes up the independent claim of the present invention.

Second, the continuous formation of uranium or uranium alloys is accomplished here by partial reduction as the reactants are added into a hot reaction zone, and completion of the reaction takes place as the molten salt moves with large surface area under a gas comprising magnesium vapor or other reductant.

With the earlier proposed use of only the molten uranium trap for the reduction of uranium fluoride, e.g., by magnesium (U.S. Pat. No. 4,552,588), molten salt floated in important amounts on the molten uranium trap. The molten salt comprised magnesium fluoride reaction by-product and an additive such as calcium chloride which would reduce the salt melting point to below that of uranium, i.e., 1133° C. In practice the complete reduction of the uranium fluoride proved difficult because it dissolved into the molten salt phase and became isolated from the magnesium reducing agent. Therefore, most of our process development turned to achieving effectively complete prereduction in a rotary furnace operating to produce solid magnesium fluoride holding finely divided uranium metal (U.S. Pat. No. 4,636,250). This mixture was then heated with calcium chloride or other additive to lower the salt melting temperature, and molten salt and molten metal were melted at temperatures a little above the 1133° C. melting point of uranium. Because of the complete prereduction, the depth of the molten salt was unimportant, and the molten uranium trap was sufficient for continuous processing, though in different reduction and separation units.

However, it would be useful to be able to carry out the reductions at nearly the same location and time as the phase separations, and this problem is solved by the present invention.

Third, operations at lower temperatures and pressures under this invention are achieved in two ways. The addition of calcium chloride to lower the by-product melting point was noted above. The use of gaseous magnesium to complete the reduction allows reduction at atmospheric pressure.

Fourth, the use of continuous dripping produces amounts of uranium product comparable with the production of even very large pressure vessels such as are used commercially. This is possible because there are long down times as the batch reductions are carried out. The amounts of molten uranium or molten salt present during continuous reductions is small.

Fifth, with magnesium as reducing agent and calcium chloride as the additive, we find that the separation of molten salt and molten uranium using this invention takes place more cleanly and at temperatures much lower than those of batch operations; therefore, this molten salt by-product starts out far less radioactive than the batch process by-product. We have shown that the calcium chloride can be extracted from magnesium fluoride by water, which dissolves only the calcium chloride, and allows its recycle. The chances are good that no further treatment of the magnesium fluoride will be necessary before its fluorine content can be recycled to hydrogen fluoride by reaction of the salt with sulfuric acid, leaving a harmless magnesium sulfate for disposal.

The continuous operations with this invention are compared with commercial operations in Table 1. The table partially summarizes the advantages of the present invention.

One object of this invention is a method of separating molten salt from molten uranium or molten uranium alloy, which separation may be substantially continuous.

Another object of this invention is a method which will allow reaction products formed nearby to be separated and removed.

Another object of this invention is a method which will allow uranium or uranium alloy to be produced and separated from by-products.

TABLE 1

Comparison of operations with this invention vs. current practice in commercial batch operations. Reaction for both: $UF_4 + 2Mg = U_{liquid} + 2MgF_2$

| | Current practice | This invention |
|---|---|---|
| Peak pressure: | about 700 psi | atmospheric |
| Peak temperature | about 1500° C. | about 1175° C. |
| Largest wt. of melts | about 4,500 lb | about 50 lb |
| Operations | batch | continuous |
| Produce uranium | yes | yes |
| Treat uranium mixtures | no | yes |
| Prepare alloys | no | yes |
| Cast directly | discontinued | yes |
| Clean/recycle scrap | not applicable | yes |
| Decontaminate and recycle by-product | no | yes |

Another object of this invention is a method which can be supplied to produce uranium or uranium alloy by partially gas phase reaction and then separate the metal from the molten salt.

Another object of this invention is a method which will allow continuous casting of molten uranium or molten uranium alloy.

Another object of this invention is a method which will allow cleaning and recycle of uranium scrap.

Another object of this invention is a method of using such separation where separated molten salt is further decontaminated while still molten.

Other objects, advantages, and novel features of this invention will be apparent to those of ordinary skill in the art upon examination of the following detailed description of preferred embodiments of the invention and the accompanying drawings.

DESCRIPTION OF THE PREFERRED EMBODIMENTS

Figure 1:
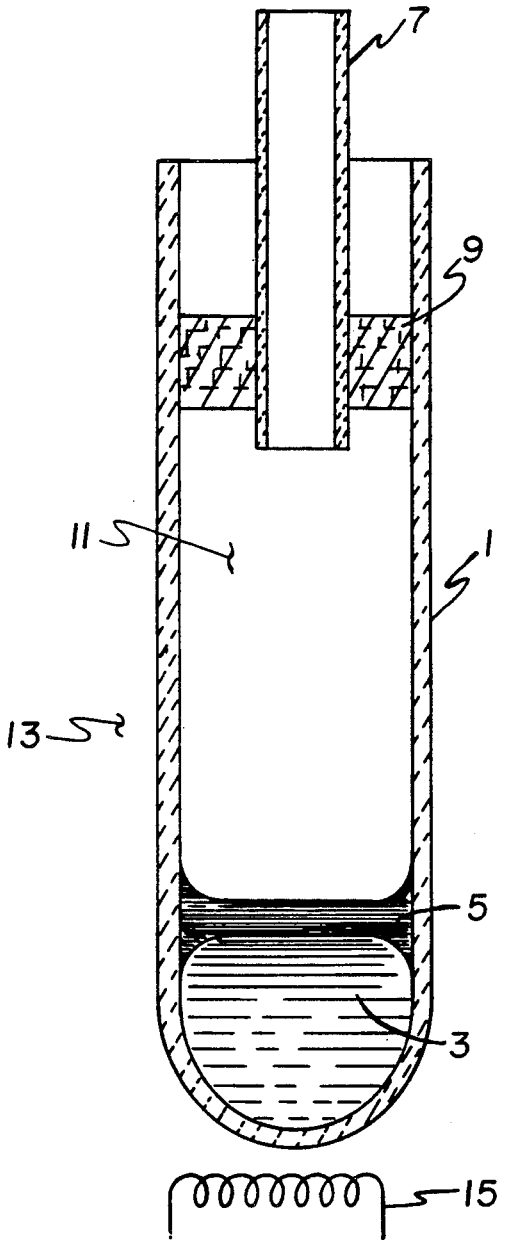
FIG. 1 is a schematic illustration of how the surfaces of molten salt and molten uranium look when they are in contact with a ceramic container such as one of alumina.

FIG. 1 is included to indicate miniscus shapes when an original ceramic tube 1 holds molten metal 3 as uranium or uranium alloy and molten salt 5. The original ceramic tube may have a loading channel 7 held by insulation 9. The original ceramic tube is filled with inert gas 11 and is surrounded by a furnace 13 with a heat source 15.

Typically, the molten metal does not wet the original ceramic tube, so the metal miniscus curves upward and away from the container surface as the miniscus moves up to the main level of the molten metal surface.

In contrast, the molten salt does wet both the molten metal and the original ceramic tube. Here molten salt fills the void left between the original ceramic tube and the molten metal miniscus, and it also climbs the wall of the original ceramic tube. This climb leads to a molten salt miniscus which curves away from the original ceramic surface as the miniscus moves down to the main level of the surface of the molten salt.

The presence of the molten salt has some influence in moving the molten metal away from the adjoining surface of the original ceramic tube, but this effect is small because the molten metal has here about six times the density of the molten salt.

This type of combination of surface tension and wetting is the basis for the separations of molten salt and molten metal used in this invention.

Figure 2:
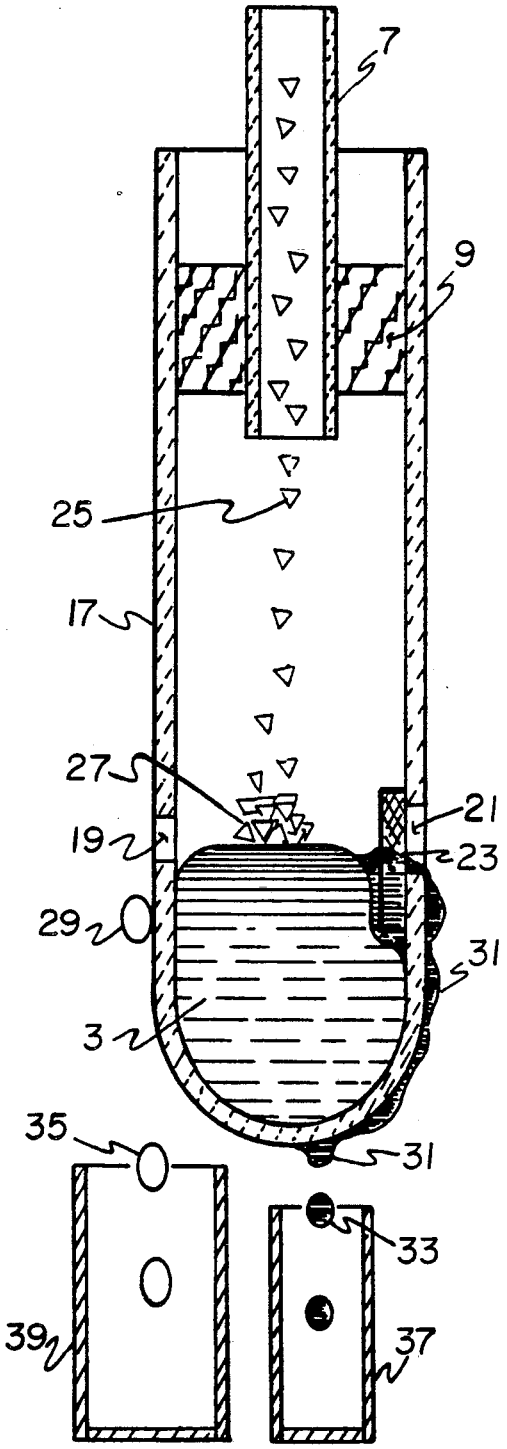
FIG. 2 is a schematic illustration of how the surfaces of molten salt and molten uranium change if a first hole covered by a frit and a second hole are cut into the container in FIG. 1 and if there is addition of reactants which form molten uranium and molten salt.

FIG. 2 shows a ceramic first reactor/separator 17 modified from the original ceramic tube 1 in FIG. 1. A molten metal outlet 19 releases excess uranium or uranium alloy if the metal level rises too high. A molten salt outlet 21 is covered by a porous frit 23.

When reactants 25 are fed into the system, they fall onto molten metal 3 where they react 27 to form molten uranium and molten salt. Excess nonwetting uranium drips out molten metal outlet 19 and falls away 29 without wetting. Excess molten salt drains along the molten metal and out through the porous frit 23 from which it moves 31 in wetting fashion along the outer surface of the first reactor/separator 17 until it drips away 33.

Dripping molten salt 33 and molten uranium 35 fall into their separate molten salt collector 37 and molten metal collector 39.

Thus molten uranium or molten uranium alloy has been formed, separated from molten salt by-product, and cast in its collector, thereby fulflling objects of the invention. Also the reduction is carried out under conditions in which the magnesium vapor pressure does not exceed atmospheric.

The reactant uranium fluoride may comprise compounds with various valences, such as $UF_3$, $UF_4$, and $UF_6$. The reducing agent will usually be magnesium, but calcium, lithium, sodium, potassium, and numerous other reductants may also be useful.

Additives such as calcium chloride or one of many other chemically unreactive salts may be added with the reactants to lower the melting point of magnesium fluoride by-product. With these additives, the operating temperature is lowered, thereby satisfying another object of the invention.

Alloying additives may be present so that a particular alloy is formed. For example, titanium dichloride might be reduced with the uranium tetrafluoride to produce uranium-titanium alloy which could be cast immediately where this alloying is not possible with current commercial practice. Thus the invention objectives of continuous reduction, alloying, and casting are met.

Also, the reactants being fed into the system may comprise scrap uranium which can be cleaned and recast, or solid mixtures of uranium and salt, e.g., its fluoride, thereby fulfilling other objectives of the invention.

The molten salt dripping to its collector should be less radioactively contaminated than the by-product of commercial reductions by the Ames process. If desired, the dripping salt can be further purified if the salt cools under a cap of molten magnesium also held in the collector. This magnesium will cause precipitation and settling out of uranium from any dissolved traces of uranium compound, e.g., uranium trifluoride, left in solution. The objective of decontamination of the by-product magnesium fluoride is accomplished in this way.

Later, calcium chloride or other water soluble additive can be extracted from contact with water insoluble magnesium fluoride by water washing. The calcium chloride can be dried and recycled, and the magnesium fluoride can be used for commercial production of fluorine, hydrogen fluoride, or other useful fluoride. These activities satisfy the by-product recycle objective and greatly reduce the need for radioactive burial.

Many container and separator materials are acceptable, notably materials comprising ceramics and graphite, but not limited to these.

Figure 3:
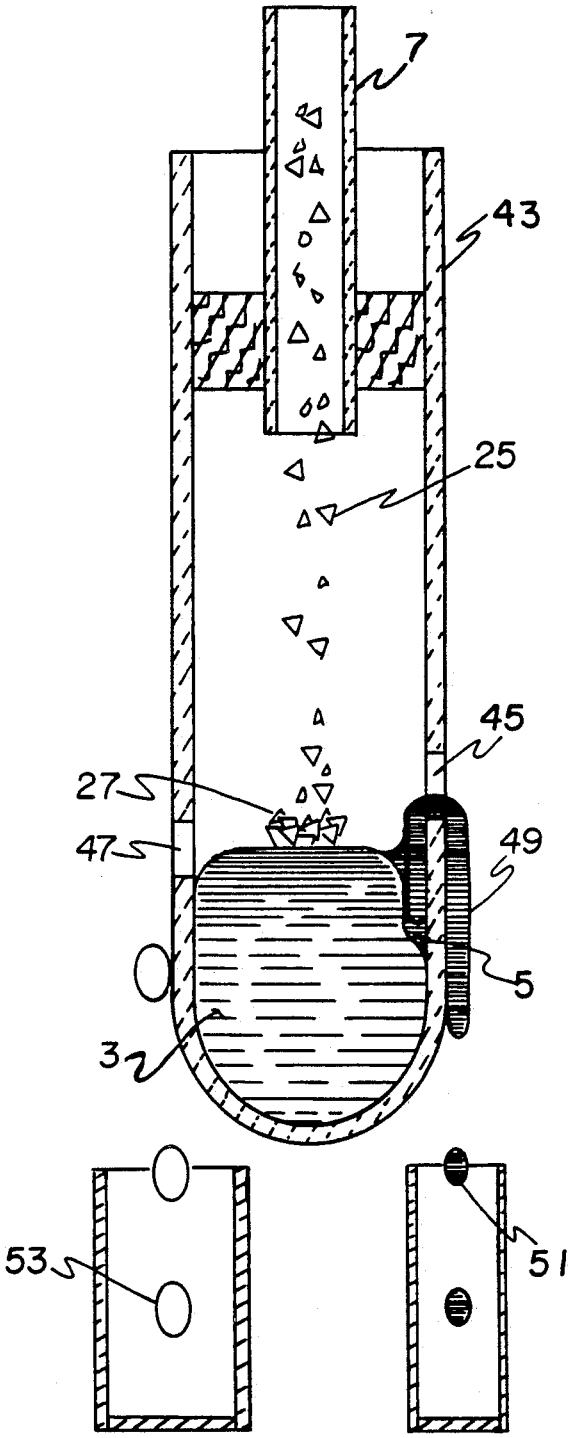
FIG. 3 is a schematic illustration of how a wick can be used to separate molten salt from molten uranium.

FIG. 3 is included as an example of a different type of barrier to pass molten salt but retain molten metal. A ceramic second reactor/separator 43 has a higher outlet 45 and lower outlet 47. A wick 49 passes through the higher outlet. The wick is not wet by molten metal 3 but is wet by molten salt 5. The molten salt rises by capillary action and fills the wick. If reactants 25 are introduced through loading channel 7, they react 27 to form molten metal and molten salt. Capillary action lifts molten salt through the higher outlet, and excess molten salt drips away 51. Excess molten metal drips out the lower outlet and falls away 53.

Figure 4:
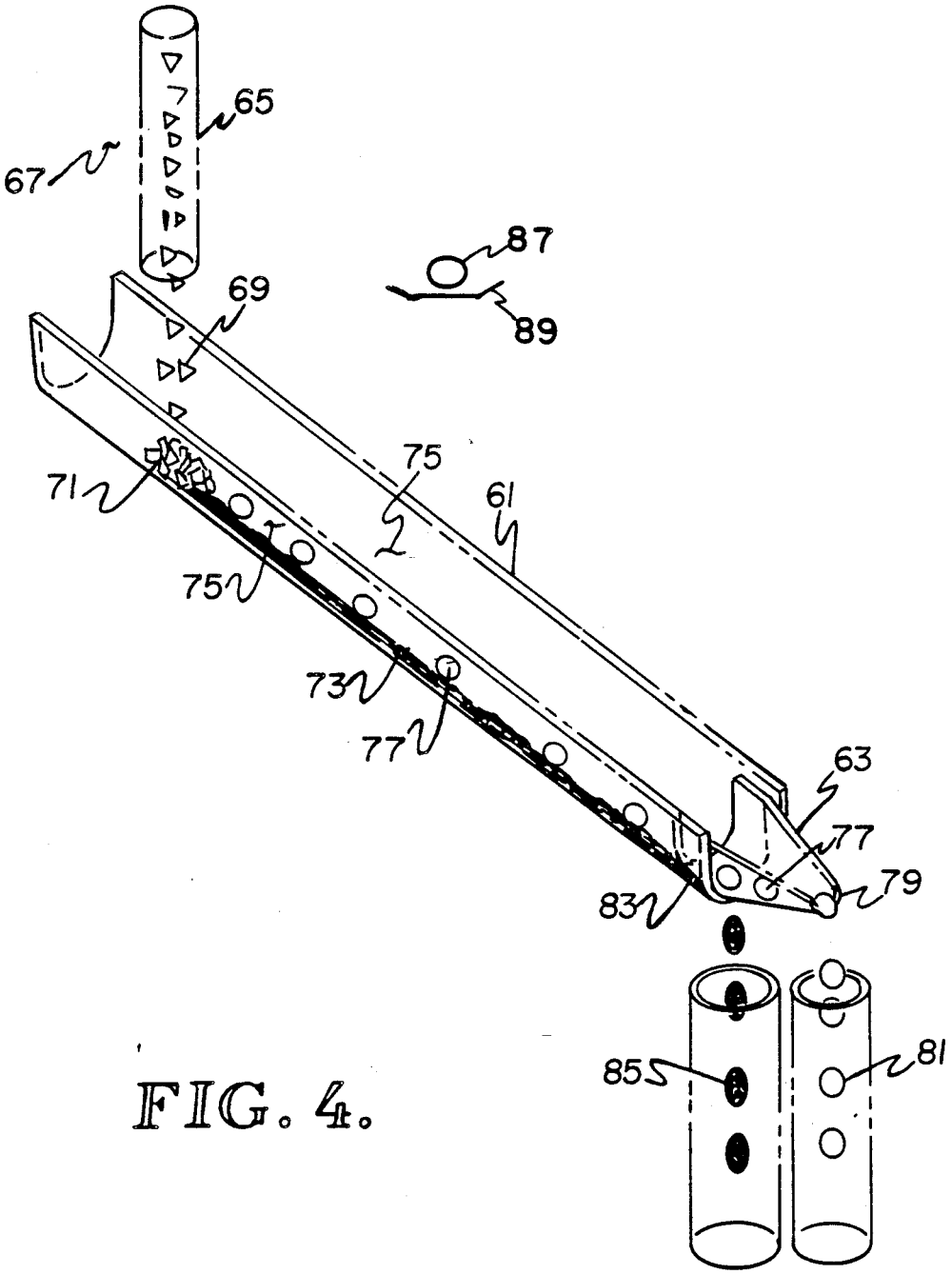
FIG. 4 is a schematic illustration of a channel exposed to magnesium vapor which is used: first, to react bulk mixtures comprising uranium fluoride and magnesium; second, to form flowing molten salt by-product of the reaction into thin layers in contact with magnesium vapor, thereby allowing complete reduction of traces of uranium fluoride by magnesium vapor; and third to separate molten uranium and molten salt at a pouring spout made of porous ceramic frit.

FIG. 4 shows a third reactor/separator 61 with pouring spout 63 formed from ceramic frit which will carry droplets of molten metal but allow droplets of molten salt to escape. A loading channel 65 provides an access route for incoming reagents. A furnace 67 provides temperature control for the reactor/separator and pouring spout so that temperatures can be maintained as high as 1250° C. The furnace also provides an inert atmosphere into which magnesium vapor can be introduced.

Reagents to form molten uranium or molten uranium alloy fall 69 into the main reaction zone 71. In this case we will consider the reagents to be a mole fraction mixture of approximately 1 part uranium tetrafluoride, 1.98 parts magnesium, and 0.5 parts calcium chloride. (Alloy precursors can also be included if desired.) The remaining 0.02 parts of magnesium for stoichiometric reaction will be supplied from vapor phase magnesium to be discussed further.

In the main reaction zone held at about 1175° C., the reagents heat up and magnesium starts to vaporize by diffusion well before its boiling point is reached. The uranium fluoride captures and reacts with any magnesium coming its way. The reduction reaction, as shown in Table 1, does not have quite enough heat of formation to supply the heat needed to reach 1175° C., so the reaction does not run out of control.

The uranium heats above its melting point, and the mixture of magnesium fluoride by-product with calcium chloride melts well below the uranium melting point.

Molten salt and molten uranium or molten uranium alloy flow down from the main reaction zone 71 and into a secondary reaction zone 73 where magnesium vapor 75 can destroy any residual uranium fluoride held by the molten salt by-product by reducing it to uranium. This molten salt wets the reactor/separator and spreads out in a thin film as it flows under the magnesium vapor.

Molten uranium, in contrast, does not wet the reactor/separator so it flows in drops 77 which do not interfere with the molten salt reactions. The molten uranium flows over the ceramic frit pouring spout 63, through the uranium outlet 79, and falls 81 to a mold for casting.

Molten salt 83 flows under and through the pouring spout 63 and drips 85 to another mold.

A reservoir of magnesium 87 in a separately controlled heat source 89 is maintained as a liquid. A magnesium vapor pressure 75 of under 1 atmosphere and desired for the second reduction zone is set by the temperature of the magnesium in the separately controlled heat source 89.

Thus molten uranium or molten uranium alloy has been formed, separated from molten, and cast in a single heated unit. The gaseous reductions have solved the problem of need for preliminary reduction in a rotary furnace as used with an earlier Elliott patent. Also, a solution has been given for the problem of operating with magnesium vapor pressures which may not to exceed 1 atmosphere when the reaction temperatures are over the magnesium boiling point.

What is claimed is:

1. An apparatus for separating molten salt from molten uranium or molten uranium alloy using a barrier which passes said molten salt but retains said molten uranium or molten uranium alloy, the operation of said barrier relying on differences in the physical behavior of said molten salt from the behavior of salt molten uranium or molten uranium alloy as they interact with each other and with said barrier, comprising:

a) a furnace with means to control temperature at various locations, b) a sufficiently inert first container which is able to hold various chemicals; said first container being emplaced in said furnace, c) a loading channel into said first container through which chemicals may be added into said first container, d) a first outlet in said first container wall in which said barrier is emplaced, wherein the barrier is capable of passing said molten salt while substantially retaining said molten uranium or molten uranium alloy, e) in said first container, a second outlet through which said molten uranium or uranium alloy can be discharged substantially free of molten salt, f) an inert second container within said furnace and placed to receive any discharge of molten salt, g) an inert third container within said furnace and placed to receive any discharge of molten uranium or molten uranium alloy, h) means to provide an inert atmosphere in said first containers, i) means for discharging said molten salt through said barrier into said second container, and j) means for discharging said molten uranium or molten uranium alloy through said outlet into said third container.

2. The apparatus according to claim 1, further comprising a reservoir of a reducing agent to supply reducing agent vapor to said first inert container.

3. The apparatus according to claim 2, further comprising means to independently control the temperature of said reservoir.

4. The apparatus according to claim 1, further comprising a casting means to cast said molten uranium or molten uranium alloy into billets of desired shape.

5. An apparatus according to claim 1 in which said barrier is a porous frit.

6. An apparatus according to claim 1 in which said barrier is bypassed by a wick.

* * * * *